US005082220A

United States Patent [19]

Pollock et al.

[11] Patent Number: 5,082,220

[45] Date of Patent: Jan. 21, 1992

[54] RESTRAINING DEVICE

[76] Inventors: Debra G. Pollock, 2221 Avenida Oliva; Robert B. Nealy, P.O. Box 3154, both of San Clemente, Calif. 92672

[21] Appl. No.: 615,287

[22] Filed: Nov. 19, 1990

[51] Int. Cl.[5] ..... A47D 15/00

[52] U.S. Cl. ..... 248/104; 248/311.2; 248/693

[58] Field of Search ..... 248/104, 102, 682, 690, 248/693, 205.2, 311.2, 328, 325, 205.5, 683; 24/306, 482, 300, 301, 302

[56] References Cited

U.S. PATENT DOCUMENTS

| | | | |
|---|---|---|---|
| 792,677 | 6/1905 | Stowell | 24/300 X |
| 1,290,433 | 1/1919 | Walker | 248/690 |
| 2,060,194 | 11/1936 | Gissubel . | |
| 2,772,801 | 12/1956 | Schwortz . | |
| 2,994,300 | 8/1961 | Grahling | 24/300 X |
| 3,410,512 | 11/1968 | Del Vecchio et al. | 248/104 |
| 3,439,387 | 4/1969 | Churches | 24/300 |
| 3,947,927 | 4/1976 | Rosenthal | 24/306 |
| 3,977,638 | 8/1976 | Woodard . | |
| 4,041,562 | 8/1977 | Nealy . | |
| 4,308,672 | 1/1982 | Antonious | 24/306 X |
| 4,416,438 | 11/1983 | King . | |
| 4,498,613 | 2/1985 | Donahue et al. . | |
| 4,630,793 | 12/1986 | Hunter . | |
| 4,718,623 | 1/1988 | McClure | 248/205.2 X |
| 4,865,239 | 9/1989 | Timbrook | 248/102 X |
| 4,946,119 | 8/1990 | Hellhake | 248/102 |
| 4,962,571 | 10/1990 | Visser | 24/301 |

FOREIGN PATENT DOCUMENTS 0730558 3/1966 Canada ..... 248/104

OTHER PUBLICATIONS

Bottlenanny, Unique Baby Products, Toronto Canada. Attach-A-Bottle Package Insert Cherubs Package Insert.

*Primary Examiner*—J. Franklin Foss

*Attorney, Agent, or Firm*—Plante Strauss Vanderburgh & Connors

[57] ABSTRACT

A restraining and support device for infants bottles and the like to prevent the bottle from being accidently or intentionally thrown to the ground or the floor is disclosed. The device consists of a flexible resilient elongated member, one end of which (the attachment end) is adapted to be attached to a fixed object and the opposite end (the grasping end) is adapted to hold an infants bottle. The attachment end of the elongated member carries adjustable loop for removably securing the device to a fixed object. The grasping end of the device carries a resilient annulus which is fitted around the neck of the bottle to be restrained. Stand-off connectors connect the grasping annulus and the strap to respective ends of the elongated member and serve keep the elongated member away from the fixed object to which it is secured to avoid entanglement of the device. The elongated flexible resilient member is preferably coiled so as to provide a spring-like action both to aid in retrieving the object should it be thrown out by the infant and also to retract the elongated member into a shortened form away from the infant when it is not attached to an object or when the infant is not utilizing the object being restrained and supported.

9 Claims, 3 Drawing Sheets

RESTRAINING DEVICE

FIELD OF THE INVENTION

The present invention relates to restraining devices and more particularly to restraining and support devices for infant's bottles, cups, pacifiers and other similar items to prevent such items from being thrown to the ground or floor by the infant.

BACKGROUND OF THE INVENTION

Children who are being bottle-fed require constant attention because of the tendency of the infants to throw the bottle onto the ground or to the floor which can result in messy spills as well as the necessity of continually sterilizing or cleaning the bottle after it has fallen to the ground or floor. This may occur particularly with infants who are seated in a high chair or a hopping cart, stroller or the like.

A number of devices are available which are adapted to be attached to an immovable object such as a high chair or a crib and which is secured to an object such as the bottle, pacifier or the like so that when the child throws down the object it is prevented from falling to the ground or floor and can be readily retrieved by the child or by an adult supervising the child.

For example, U.S. Pat. No. 4,416,438 discloses a device consisting of a flexible strap having an adjustable loop on one end and a suction cup affixed to the loop at its opposite end for being secured to a surface such as a high chair, crib or the like. The adjustable loop is defined by one or more beads which are movable for defining the minimum and maximum size of the loop. This device is limited, however, by the use of the suction cup which requires a surface area which is relatively flat for proper and secure attachment of the suction cup. In addition, the required length of the flexible strap is such that a child may become entangled by the strap which can possibly result in injury to the child. Other similar devices are also on the market which incorporate a short flexible elongated member having a loop at one end which includes snaps for forming the loop and which carries means on the opposite end to secure the device to a baby's bottle. The elongated member is conventionally made out of woven polypropylene fiber and, although flexible, the elongated member is not resilient. To reduce the danger that an infant might be caught up in the elongated member and injure itself, the length of the elongated member is limited to the point that it, being non-resilient, may interfere with the infants ability to drink from the bottle.

U.S. Pat. No. 4,630,793 describes another type of restraining device which requires attachment to the chair arms of a child's seat and is thus limited to use only in those situations where a pair of chair arms are available for attachment of the device.

U.S. Pat. No. 2,772,801 describes yet another restraining device which requires the use of a complicated harness in which the entire bottle is enclosed. A similar device is disclosed in U.S. Pat. No. 2,060,194 which is adapted for use in a crib and which employs a relatively long strap which can be used either in the crib or which can be looped around the body of a person feeding the baby for supporting the bottle when not in use. The length of the strap, particularly when used in a crib, would appear to pose a danger that an infant may become entangled in the strap. Also, the aforementioned devices utilize complicated harnesses for holding the object to be restrained, thus limiting the use of the device only to certain objects which will fit into the harness, such as a baby's bottle.

U.S. Pat. Nos. 3,977,638 and 4,498,613 relate to restraining devices for supporting a bottle or other objects while the infant is being held. These devices are designed to be worn on the body of the person holding the infant.

SUMMARY OF THE INVENTION

It is an object of this invention to provide an improved restraining and support device for use with bottles associated with the care and feeding of infants and young children.

Another object of the invention is to provide a restraining and support device which reduces the risk of an infant becoming entangled or otherwise injured by the device.

Another object of the invention is to provide a restraining and support device which can be used in those situations where the child is not being held by a person, such as when the child is seated in a high chair, stroller or the like.

Yet another object of the invention is to provide a device which restrains infant feeding bottle or the like to prevent it from falling to the ground or floor and which can support the bottle without spilling its contents so that the bottle may be readily retrieved by a person attending the child or by the child itself.

These and other objects are achieved by the improved restraining and support device of the present invention which comprises a flexible resilient elongated member, one end of which (the attachment end) is adapted to be attached to a fixed object and the opposite end (the grasping end) is adapted to hold an object to be restrained and supported such as for example an infants bottle and the like. The attachment end of the elongated member carries a strap including locking means for securing the ends of the strap to define an adjustable loop for removably securing the device to a fixed object. The grasping end of the device carries a resilient annulus which is fitted securely around the neck of an infants feeding bottle.

The elongated flexible resilient member is preferably coiled so as to provide a spring-like action both to aid in retrieving the object should it be thrown out by the infant and also to retract the elongated member into a shortened form away from the infant when it is not attached to an object or when the infant is not utilizing the object being restrained and supported.

These and other objects and advantages of the present invention will become apparent from the following detailed description and accompanying drawings.

DETAILED DESCRIPTION OF THE INVENTION

Figure 1:
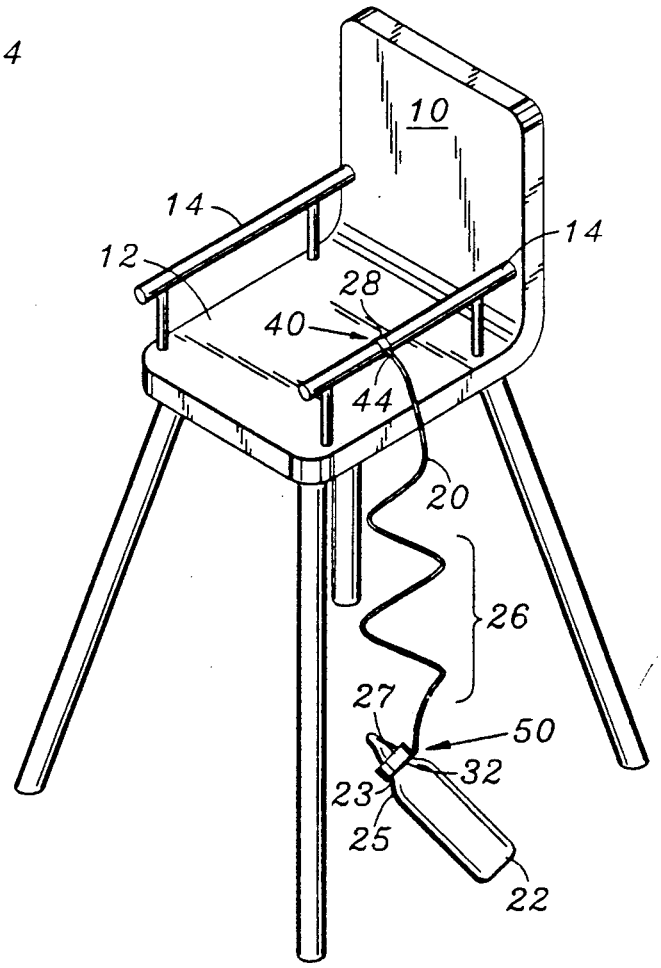
FIG. 1 is a perspective view showing a restraining device in accordance with the invention restraining and securing an infant's bottle to a high chair.

Referring now to the drawings, particularly FIG. 1, there is illustrated a conventional infant's high chair 10 comprising a seat and back rest portion 12 and arms 14 on which may be slidably attached a tray or similar device (not shown). A restraining device 20 constructed in accordance with the present invention is illustrated as being secured to one of the side arms 14 for restraining and supporting an infant's feeding bottle 22 of conventional design having a neck 23 of smaller diameter than the body of the bottle 22, a shoulder 25 defined between the body of the bottle 22 and the neck 23 and a closure 27 which as illustrated includes a nipple.

Figure 2:
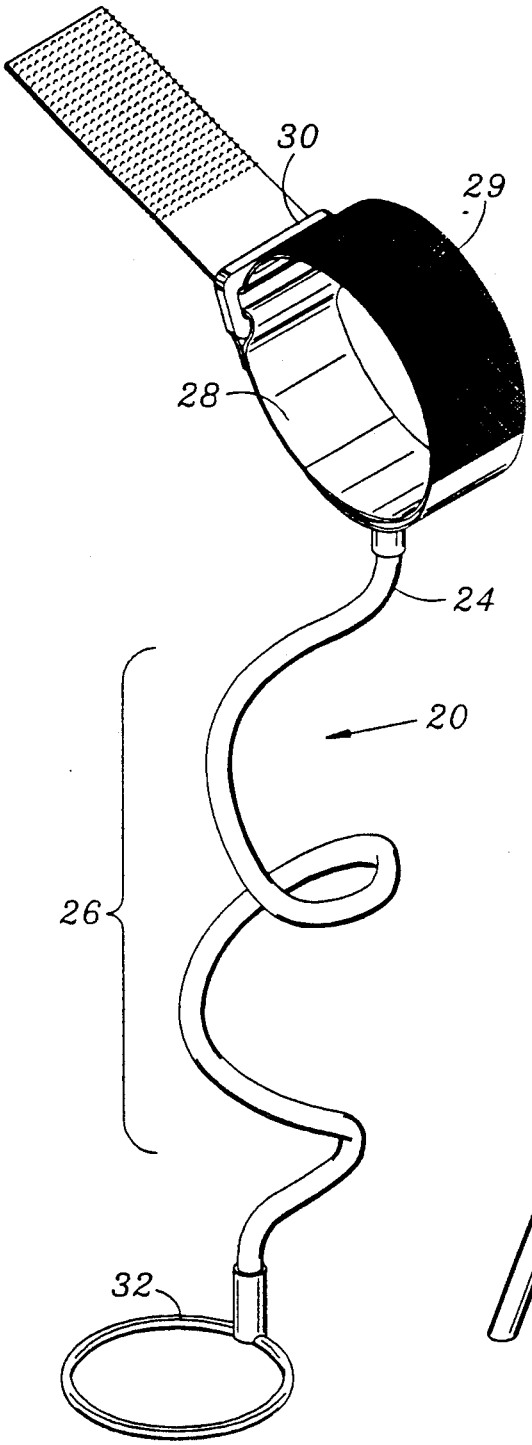
FIG. 2 is a perspective view of the restraining and securing device of the present invention.

As is more clearly shown in FIG. 2, the device 20 comprises a flexible resilient elongated member 24 which, as illustrated, is preferably formed with a coil portion 26 which serves to provide resiliency to the elongated member 24 to retract or shorten the overall length of the elongated member 24 when the device 20 is not in use. This feature aids in preventing the child from becoming entangled with the elongated member 24 and keeps the device 20 out of the way when not in use.

A strap 28, formed into an adjustable loop, is carried on one end of the elongated member 24 to define an attachment end of the device 20 for attaching it to a fixed object, such as for example one of the side arms 14 of the high chair 10, as illustrated in FIG. 1. The loop is made adjustable by means of a D-ring 30 which is provided on one end of the strap 28 while the other end of the strap 28 is passed through the D-ring, passed back on itself and secured to form the loop. Preferably, the strap 28 forming the loop is formed of a self locking material such as VELCRO® material and includes a strip of material 29 carrying corresponding fingers positioned along the end of the strap 28 so that the end of the strap 28 can be secured anywhere along the length of the strap 28 thereby permitting the adjustment of the loop to fit around essentially any object to which it is desired to secure the device 20.

The opposite end of the elongated member carries a resilient annulus 32 to define the grasping end of the device 20. The annulus 32 is formed with an circumference somewhat smaller than the neck 23 of an infants feeding bottle for which it is designed to grasp and the annulus 32 is expanded to snugly receive the neck 23 of the bottle. The annulus 32 is formed of resilient rod or tubing having an outside diameter such as to permit the bottle closure to be secured over the mouth and neck 23 of the bottle with the annulus 32 disposed between the closure and the shoulder 25 defined between the bottle neck 23 and body (FIG. 6) much in the manner of an 0-ring. In addition to being resilient, it is preferred that the annulus 32 also have a relatively high coefficient of friction so that relatively smooth objects such as plastic or glass bottles and the like are even less likely to slide out of the annulus 32 during use. Excellent results have been achieved when the annulus 32 is formed of urethane tubing which is both resilient and which has a relatively high coefficient of friction so as to prevent objects received within the annulus 32 from sliding out.

It will be understood that while the device of the invention is described herein in connection with infants feeding bottles, the circumference of the annulus 32 can be demean to receive other types of containers, such as a cup or bottle. In those cases the annulus 32 is fitted about the container adjacent the outlet end so that when the container is restrained and supported by the device 20 it is oriented with its outlet end above its bottom to retain the contents in the container.

Figure 3:
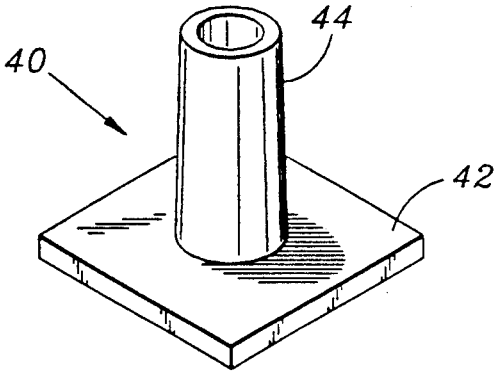
FIG. 3 is a perspective view of a connector utilized for the attachment end of the device of the present invention.
Figure 4:
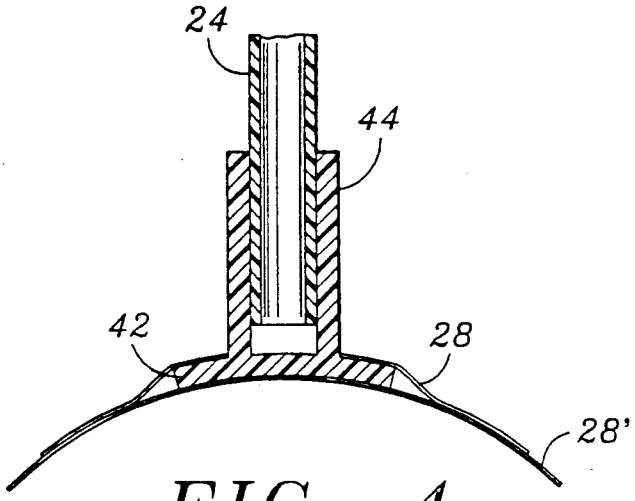
FIG. 4 is an enlarged scale sectional elevation of the attachment end of the device of FIG. 2.

Referring now to FIGS. 3 and 4, there is illustrated a connector for the attachment end of the device 20 which has been found highly suitable for connecting the end of the elongated member 24 with the strap 28.

As most clearly shown in FIG. 3, the connector, illustrated generally as 40, consists generally of a rectangular base member 42 and an upstanding tubular member 44 which extends essentially perpendicular to the plane of the base 42. The base is then bonded or secured with a flap of material (28' in FIG. 4) to the strap 28. The upstanding tubular member 44 is provided with a bore having essentially the same diameter as the outside diameter of the elongated member 24 so that the elongated member 24 can be inserted into the bore of the upstanding member 44 and secured therein by suitable adhesive.

The upstanding member 44 of the connector 40 is preferably only slightly resilient and is sufficiently rigid to support the weight of the elongated member 24 and the object being grasped and restrained by the device 20. This provides a standoff feature which serves to keep the device 20 and any object to which it may be attached away from the infant and from the fixed object to which the device 20 is secured. As illustrated in FIG. 1 the connector 40 is oriented so that the member 44 is facing away from where the infant would be sitting in seat 12 and the member 44 acts as a cantilever so that the elongated member 24 is held away from the chair 10 thus reducing the chance that the elongated member 24 will become entangled with the chair 10.

Figure 5:
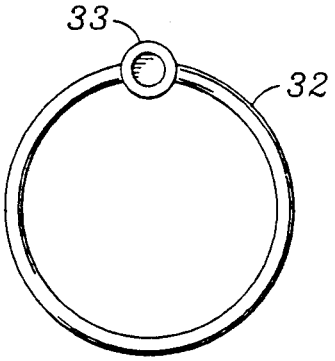
FIG. 5 is a top plan view in enlarged scale of one embodiment of the grasping end of the device of FIG. 2.
Figure 6:
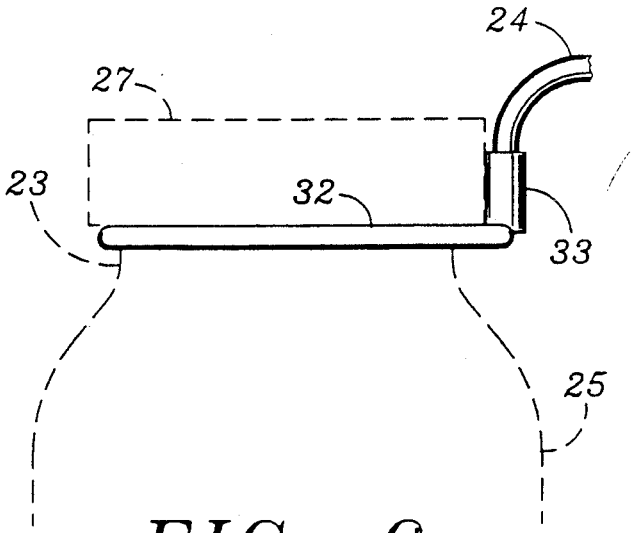
FIG. 6 is a side elevation of the grasping end illustrated in FIG. 5.

The annulus 32 is likewise connected to the elongated member 24 by a connector having an upstanding member which provides the standoff function. Referring to FIGS. 5 and 6, the connector consists of an upstanding tubular member 33 to which the ends of the annulus 32 are integrally molded. The annulus 32 and the tubular member 33 are molded from a resilient material, such as urethane. An end of the elongated member 24 is received in the bore of the upstanding member 33 and can be permanently bonded therein.

Figure 7:
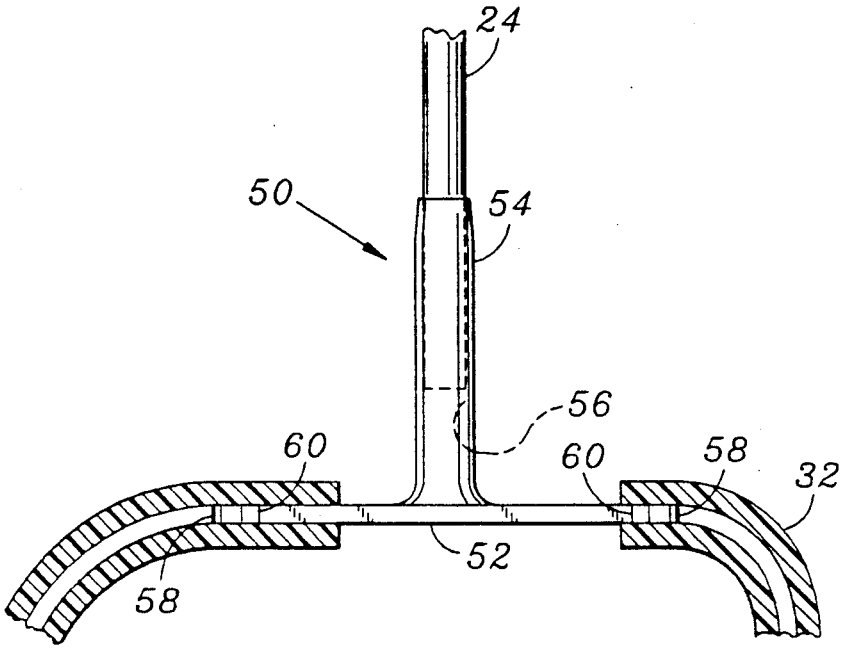
FIG. 7 is an enlarged scale side view partially in section of another embodiment of the grasping end of the device of FIG. 2.
Figure 8:
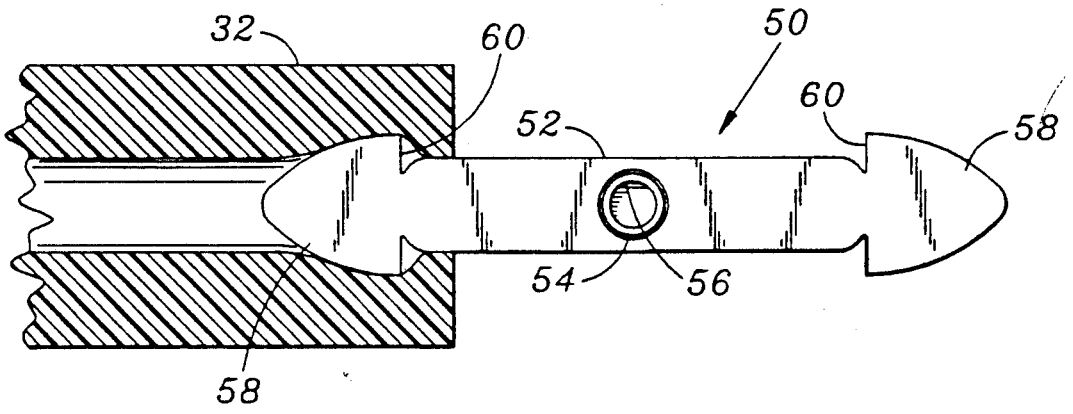
FIG. 8 is a top plan view of a connector for the grasping end of the device illustrated in FIG. 7.

In another embodiment the annulus 32 is adapted to be removed from the connector and exchanged for one of different circumference such as when the device 20 is to be used to restrain several different objects, for example a feeding bottle and a cup. Referring to FIGS. 7 and 8, the annulus is formed from resilient tubing and a connector for the annulus 32, illustrated generally as 50, is provided with a base 52 and an upstanding member 54 having a bore 56 for receiving the end of the elongated member 24 in the same manner as described for the connector 40. The base member 52, however, is elongated and the width of the base 52 is demean to permit insertion in the bore of the tubing forming the annulus 32. The base 52 is preferably provided with arrow-shaped ends 58 which are wider than the base member 52 so as to define shoulders 60. The arrow-shaped ends 58 are inserted in the bore of the tubing forming the annulus 32 and the shoulders 60 serve to prevent removal of the ends of the annulus 32 from the base member when the annulus 32 is expanded. It will be understood that as the annulus 32 is expanded it's bore decreases in diameter thus exerting even greater pressure against the shoulders 60 so that the ends of the annulus 32 are held even more firmly on the base member 52 than when the annulus 32 is relaxed.

It will be understood that various arrangements other than those described in detail in the specification will occur to those persons skilled in the art, which arrangements lie within the spirit and scope of the invention. It is, therefore, to be understood that the invention is to be limited only by the claims impended hereto.

Having described the invention, we claim:

1. A restraining and securing device for an object such as an infant's bottle, a cup, a pacifier and the like, said device comprising a flexible, resilient, elongated member having ends defining a grasping end and an attachment end opposite said grasping end;

a stand-off connector affixed to each end of said elongated member;

adjustable attachment means carried by one of said stand-off connectors for removably securing the device to a fixed object thereby to define said attachment end of said device;

resilient grasping means for retaining said object to be restrained and secured by said device carried by said other stand-off connector thereby to define said grasping end of said device.

2. The device of claim 1 wherein said elongated flexible resilient member is coiled intermediate said ends thereof thereby to provide a spring action to normally retract the elongated member to shorten its length.

3. The device of claim 1 wherein said stand-off connector consists of a base member and a tubular member which extends essentially perpendicular to the plane of said base member, said tubular member having a bore opening at the end of said tubular member opposite said base member for receiving an end of said elongated member therein to affix said stand-off connector to said elongated member.

4. The device of claim 1 wherein said grasping end of said elongated member is defined by a resilient annulus having a circumference smaller than the neck of an infants feeding bottle for which it is designed to grasp, said annulus being expandable to receive and grasp said neck of said infants feeding bottle.

5. The device of claim 4 wherein said annulus has a high coefficient of friction for grasping smooth objects such as plastic or glass bottles and the like.

6. The device of claim 4 wherein said annulus is formed of latex tubing.

7. The device of claim 1 wherein said attachment means comprises a strap defining an adjustable loop, said strap including a D-ring at one end thereof and said loop being formed when an opposite end of said strap is passed through said D-ring and looped back on itself, said strap further including means for removably securing said opposite end of said strap along the length of said strap to adjustably close said loop.

8. The device of claim 4 wherein said annulus is formed from open ended resilient tubing having a bore and said connector consists of an elongated base having opposite arrow-shaped end portions defining perpendicularly extending shoulders, said arrow-shaped end portions of said base member being inserted into the bore of said resilient tubing at each open end thereof to retain said tubing as an annulus, said base member carrying at a tubular upstanding member having a bore for receiving an end of said elongated member.

9. The device of claim 8 wherein said annulus and said connector are integrally formed.

* * * * *